US012219993B2

(12) United States Patent
Chen et al.

(10) Patent No.: US 12,219,993 B2
(45) Date of Patent: Feb. 11, 2025

(54) CLOSURE BODY AND CARTRIDGE

(71) Applicant: SHENZHEN EVERWIN PRECISION TECHNOLOGY CO., LTD., Guangdong (CN)

(72) Inventors: Xiaoshuo Chen, Guangdong (CN); Su Lu, Guangdong (CN); Quanyi Liu, Guangdong (CN); Zhian He, Guangdong (CN); Chongwei Wang, Guangdong (CN)

(73) Assignee: SHENZHEN EVERWIN PRECISION TECHNOLOGY CO., LTD., Guangdong (CN)

( * ) Notice: Subject to any disclaimer, the term of this patent is extended or adjusted under 35 U.S.C. 154(b) by 837 days.

(21) Appl. No.: 17/362,167

(22) Filed: Jun. 29, 2021

(65) Prior Publication Data

US 2021/0321670 A1 Oct. 21, 2021

Related U.S. Application Data

(63) Continuation of application No. PCT/CN2020/087467, filed on Apr. 28, 2020.

(30) Foreign Application Priority Data

Jul. 10, 2019 (CN) ..... 201910618726.4
Jul. 10, 2019 (CN) ..... 201910618729.8
(Continued)

(51) Int. Cl.
*A24F 40/42* (2020.01)
*A24F 40/10* (2020.01)
(Continued)

(52) U.S. Cl.
CPC ..... *A24F 40/42* (2020.01); *A24F 40/10* (2020.01); *A24F 40/485* (2020.01); *A24F 40/46* (2020.01)

(58) Field of Classification Search
CPC ..... A24F 40/40; A24F 40/42; A24F 40/46; A24F 40/485
See application file for complete search history.

(56) References Cited

U.S. PATENT DOCUMENTS 9,220,303 B2 * 12/2015 Li ..... A61M 15/06
10,537,138 B2 * 1/2020 Li ..... A24F 40/42
(Continued)

FOREIGN PATENT DOCUMENTS

CN 202456410 U 10/2012
CN 203538370 U 4/2014
(Continued)

OTHER PUBLICATIONS

Extended European Search Report issued Aug. 8, 2023 in EP 20837467.8.
(Continued)

*Primary Examiner* — Thanh Tam T Le
(74) *Attorney, Agent, or Firm* — W&G Law Group

(57) ABSTRACT

A closure body includes a closure member and a sealing member formed on closure member. The closure member includes a closure end, an accommodation end extending downward from closure end, an e-liquid passage running through closure end and extending to accommodation end, and an air passage separated from e-liquid passage. The air passage includes a connection air passage running through top of closure end, a longitudinal air passage longitudinally running through closure end and communicating with connection air passage, and an outer-side air passage extending from outer edge of longitudinal air passage to accommoda-
(Continued)

tion end. A notch is formed in middle of accommodation end. The sealing member includes a first sealing portion—formed at accommodation end, a second sealing portion extending from first sealing portion toward closure end, and a third sealing portion formed at periphery of top of closure end and integrated with second sealing portion.

15 Claims, 10 Drawing Sheets

(30) Foreign Application Priority Data

Jul. 10, 2019 (CN) ..... 201910618874.6
Jul. 10, 2019 (CN) ..... 201910618894.3

(51) Int. Cl.
*A24F 40/485* (2020.01)
*A24F 40/46* (2020.01)

(56) References Cited

U.S. PATENT DOCUMENTS

| | | | | |
|---|---|---|---|---|
| 10,595,566 | B2 * | 3/2020 | Jiang | A24F 40/42 |
| 11,185,111 | B2 * | 11/2021 | Fu | A24F 40/46 |
| 11,246,346 | B2 * | 2/2022 | Yang | A24F 40/42 |
| 11,330,842 | B2 * | 5/2022 | Xu | A24F 40/46 |
| 11,528,940 | B2 * | 12/2022 | Zhang | A24F 40/46 |
| 11,793,236 | B2 * | 10/2023 | Tan | B65B 7/2828 |
| 2022/0001121 | A1 * | 1/2022 | Lahoud | A61M 15/06 |
| 2022/0256925 | A1 * | 8/2022 | Zhang | A24F 40/44 |
| 2022/0330607 | A1 * | 10/2022 | Wong | A24F 40/10 |
| 2023/0045836 | A1 * | 2/2023 | Aller | A24F 40/40 |
| 2023/0101573 | A1 * | 3/2023 | Moloney | G09B 21/003 131/328 |

FOREIGN PATENT DOCUMENTS

| | | | |
|---|---|---|---|
| CN | 204070571 | U | 1/2015 |
| CN | 104872822 | A | 9/2015 |
| CN | 204599335 | U | 9/2015 |
| CN | 105361249 | A | 3/2016 |
| CN | 205337595 | U | 6/2016 |
| CN | 205757180 | U | 12/2016 |
| CN | 205813571 | U | 12/2016 |
| CN | 205987968 | U | 3/2017 |
| CN | 107404944 | A | 11/2017 |
| CN | 206923678 | U | 1/2018 |
| CN | 108272141 | A | 7/2018 |
| CN | 108308716 | A | 7/2018 |
| CN | 207613191 | U | 7/2018 |
| CN | 208144419 | U | 11/2018 |
| CN | 109007980 | A | 12/2018 |
| CN | 208354592 | U | 1/2019 |
| CN | 208354607 | U | 1/2019 |
| CN | 208403258 | U | 1/2019 |
| CN | 208434719 | U | 1/2019 |
| CN | 109288136 | A | 2/2019 |
| CN | 109330028 | A | 2/2019 |
| CN | 109393569 | A | 3/2019 |
| CN | 109452691 | A | 3/2019 |
| CN | 208724904 | U | 4/2019 |
| CN | 109717519 | A | 5/2019 |
| CN | 209073553 | U | 7/2019 |
| CN | 110338460 | A | 10/2019 |
| CN | 110338461 | A | 10/2019 |
| CN | 110338462 | A | 10/2019 |
| CN | 110338463 | A | 10/2019 |
| CN | 211153793 | U | 8/2020 |
| CN | 211153794 | U | 8/2020 |
| CN | 211211423 | U | 8/2020 |
| DE | 2653133 | A1 | 5/1978 |
| EP | 3153036 | A1 | 4/2017 |
| KR | 20130003944 | U | 7/2013 |
| WO | WO 2016/090601 | A1 | 6/2016 |
| WO | WO 2018218421 | A1 | 12/2018 |
| WO | WO 2019/037701 | A1 | 2/2019 |

OTHER PUBLICATIONS

Office Action issued Jul. 7, 2023 in CN 201910618874.6.
Office Action issued Jan. 22, 2024 in CN 201910618894.3.
Office Action issued Dec. 15, 2023 in CN 201910618726.4.
Office Action issued Nov. 24, 2023 in CN 201910618874.6.
International Search Report from International Application No. PCT/CN2020/087467 (mailed Aug. 5, 2020).
Search Report issued Jan. 20, 2021 in CN 201910618729.8.
Office Action issued Jan. 29, 2021 in CN 201910618729.8.
Notification to Grant Patent Rights for Invention issued Jun. 10, 2024 in CN 201910618874.6, 6 pp.

* cited by examiner

CLOSURE BODY AND CARTRIDGE

CROSS-REFERENCE TO RELATED APPLICATIONS

This patent application is a continuation of International Application Serial No. PCT/CN2020/087467, filed on Apr. 28, 2020, which claims priority to and the benefit of Chinese Patent Application Nos. 201910618726.4, 201910618729.8, 201910618894.3 and 201910618874.6, each filed on Jul. 10, 2019. The disclosures of the aforementioned applications are hereby incorporated by reference in their entireties.

TECHNICAL FIELD

The present disclosure relates to the field of e-cigarettes, and in particular, to a closure body and a cartridge.

BACKGROUND

Patent Application No. 201811033876.0 of the People's Republic of China discloses an atomizer and an e-cigarette, including an atomizing core, a first plastic member assembling the atomizing core, a second plastic member, a housing that sleeves an exterior of the first plastic member, and a cover body held with the housing and covering the exterior of the second plastic member. A first sealing portion is clamped between the atomizing core and the first plastic member, and a second sealing portion is clamped between a periphery of the first plastic member and the housing. The first plastic member is further provided with an air hole. The housing is provided with an air passage communicating with the air hole. The air hole is connected to the air passage, and a third sealing member is clamped therebetween. The first, second, and third sealing members are provided to prevent e-liquid from leaking from the housing. The three sealing members are provided independently and need to be assembled between corresponding parts and components. Moreover, the sealing members are made of silica gel materials, which are soft and difficult to achieve automatic production, and need to be manually assembled. As a result, a manufacturing efficiency thereof is low, and it is difficult to guarantee the quality. Besides, it is difficult to solve the problem of water vapor condensation of the cartridge.

SUMMARY

In view of this, there is a need to provide a closure body and a cartridge that can reduce vapor condensation, prevent leakage, and facilitate automatic assembly.

A closure body, including a closure member and a sealing member formed on the closure member; the closure member including a closure end, an accommodation end extending downward from the closure end, at least one e-liquid passage running through the closure end and extending to the accommodation end, and an air passage separated from the at least one e-liquid passage; the air passage including a connection air passage running through the top of the closure end, a longitudinal air passage longitudinally running through the closure end and communicating with the connection air passage, and an outer-side air passage extending from an outer edge of the longitudinal air passage to the accommodation end, wherein a notch is formed in middle of the accommodation end; the sealing member includes an atomizing core installation cavity formed in the notch, and a third sealing portion formed at the closure end; a cavity wall of the atomizing core installation cavity at a longitudinal side is recessed inward, corresponding to a lower part of the outer-side air passage, to form a recessed channel, and a perforation is formed by running through the recessed channel; an atomizing cavity communicating with the perforation is formed at a lower part of the atomizing core installation cavity; the perforation, the recessed channel, the outer-side air passage, the longitudinal air passage, and the connection air passage form the air passage; and a second sealing portion is integrally formed at two sides of the perforation, the recessed channel, the outer-side air passage, and the longitudinal air passage.

A closure body, including a closure member and a sealing member formed on the closure member; the closure member including a closure end, an accommodation end extending downward from the closure end, at least one e-liquid passage running through the closure end and extending to the accommodation end, and an air passage separated from the at least one e-liquid passage; the air passage including a connection air passage running through a top of the closure end, a longitudinal air passage longitudinally running through the closure end and communicating with the connection air passage, and an outer-side air passage extending from an outer edge of the longitudinal air passage to the accommodation end, wherein a notch is formed in middle of the accommodation end; the sealing member includes a first sealing portion formed at the accommodation end, and a third sealing portion formed at the closure end; the first sealing portion includes an atomizing core installation cavity formed in the notch, and a first sealing ring formed around outer peripheries of the accommodation end and the notch; the third sealing portion includes a second sealing ring formed around an outer periphery of the closure end, and a third sealing ring formed at an inner side of the connection air passage; and the second sealing ring and the first sealing ring provide a double-sealing structure.

A cartridge, including a cartridge tube provided with a flue and an e-liquid storage cavity, a closure body installed in the cartridge tube and closing the e-liquid storage cavity, an atomizing core installed in the closure body, and a base fixed to the cartridge tube, wherein the closure body includes a closure member and a sealing member formed on the closure member; the closure member includes a closure end, an accommodation end extending downward from the closure end, at least one e-liquid passage running through the closure end and extending to the accommodation end, an air passage separated from the at least one e-liquid passage, and a notch provided in middle of the accommodation end; the sealing member includes an atomizing core installation cavity formed in the notch; the atomizing core is placed and fixed in the atomizing core installation cavity; the base is provided with a conductive pillar connected to a power supply, and the conductive pillar abuts against a lower surface of the atomizing core to provide support for the atomizing core; an upper part of the base abuts against a lower part of the accommodation end; and the base is fixed to the cartridge tube.

A cartridge, including a cartridge tube provided with a flue and an e-liquid storage cavity, a closure body installed in the cartridge tube and closing the e-liquid storage cavity, an atomizing core installed in the closure body, and a base fixed to the cartridge tube, wherein the cartridge further includes a suction nozzle disposed at a top end of the cartridge tube; the suction nozzle includes a top portion, an insertion portion extending downward from the top portion, and a suction hole running through the top portion and the insertion portion; the insertion portion is provided with an adsorption space at an outer periphery of the suction hole; an adsorption member is provided in the adsorption space; and the adsorption space communicates with the flue to make the adsorption member adsorb water vapor of smoke in the flue.

The details of one or more embodiments of the present disclosure are set forth in the following drawings and description. Other features, objects and advantages of the present disclosure will become clear from the description, drawings and claims.

BRIEF DESCRIPTION OF DRAWINGS

The accompanying drawings described herein are used to provide further illustration of the present disclosure, and constitute a part of the present disclosure. Schematic embodiments of the present disclosure and description thereof are used to explain the present disclosure, and do not constitute improper limitations on the present disclosure.

DESCRIPTION OF EMBODIMENTS

Figure 1:
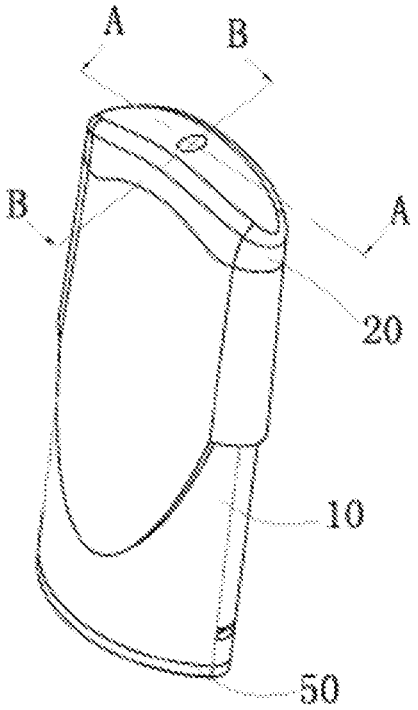
FIG. 1 is a perspective view of a cartridge according to the present disclosure.

To make the objectives, technical solutions, and advantages of the present disclosure clearer, the technical solutions of the present disclosure will be further described in the following with reference to specific embodiments and corresponding accompanying drawings in the present disclosure.

Referring to FIG. 1 to FIG. 18, a cartridge of the present disclosure includes a cartridge tube 10 provided with a flue 13 and an e-liquid storage cavity 12, a closure body installed in the cartridge tube 10 and closing the e-liquid storage cavity 12, an atomizing core 30 installed in the closure body, a base 50 fixed to the cartridge tube 10, and a suction nozzle 20 installed to a top end of the cartridge tube 10.

Particularly referring to FIG. 12 to FIG. 18, the cartridge tube 10 includes a tube body 11, an e-liquid storage cavity 12 disposed in the tube body 11, a flue 13 disposed in the tube body 11 and running through in a vertical direction, a mating portion 15 disposed at the top of the tube body 11, and a first snapping portion 14 disposed at two sides of the bottom of the tube body 11. The flue 13 includes a flue tube 131 extending from the top of the tube body 11 into the e-liquid storage cavity 12, a smoke hole 133 formed in the middle of the flue tube 131, and an insertion portion 132 formed at the bottom of the flue tube 131. An outer diameter of the insertion portion 132 is smaller than an outer diameter of the flue tube 131. Two sides of the mating portion 15 are provided with positioning pillars 151, and an e-liquid suction cavity 152 disposed at a top position of the flue 13. The smoke hole 133 at the top of the flue 13 is of a trumpet-shaped structure. Preferably, the flue 13 is disposed in the middle of the e-liquid storage cavity 12. In specific implementation, the flue 13 may also be disposed at one side or two sides of the e-liquid storage cavity 12.

Figure 14:
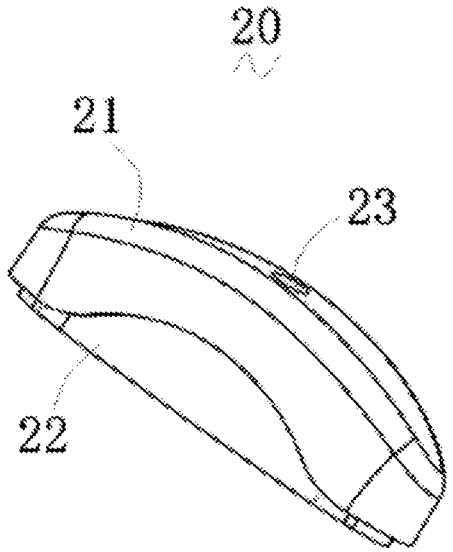
FIG. 14 is a perspective view of a suction nozzle of the cartridge according to the present disclosure.
Figure 15:
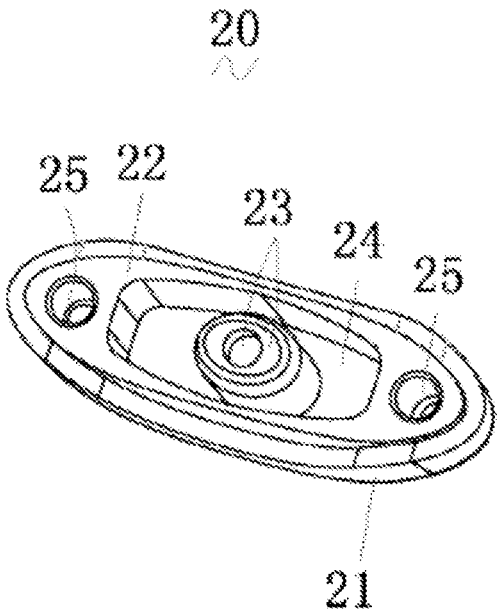
FIG. 15 is another perspective view of the suction nozzle of the cartridge according to the present disclosure.
Figure 16:
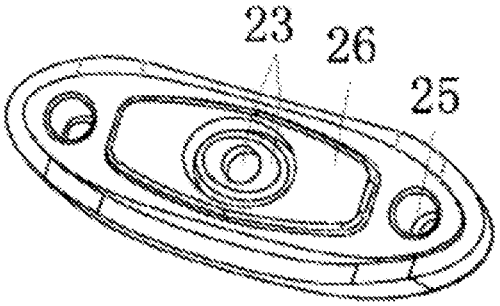
FIG. 16 is a perspective view of the suction nozzle, which is assembled with an adsorption member, of the cartridge according to the present disclosure.

Particularly referring to FIG. 14 to FIG. 16, the suction nozzle 20 includes a top portion 21, an insertion portion 22 extending downward from the top portion 21, and a suction hole 23 running through the top portion 21 and the insertion portion 22 and communicating with the smoke hole 133. Two sides of the insertion portion 22 are provided with positioning holes 25 at positions corresponding to the positioning pillars 151, and an adsorption space 24 is provided at an outer periphery of the suction hole 23. The adsorption space 24 is provided therein with an adsorption member 26, which is disposed around the outer periphery of the suction hole 23 and communicates with the smoke hole 133.

The adsorption member 26 is made of a polymer fiber material and has strong water vapor adsorption capability. During assembly, the insertion portion 22 of the adsorption member 26 is inserted into the e-liquid suction cavity 152 of the mating portion 15 at the top end of the tube body 11, and the positioning pillars 151 are inserted into the positioning holes 25 of the adsorption member 26. When a user sucks from the suction nozzle 2, smoke moves upward from the flue 13, and most water vapor in the smoke is adsorbed on the adsorption member 26.

In specific implementation, the adsorption member 26 may completely cover an upper part of the smoke hole 133, so that the smoke can be sucked by the user only through the adsorption member 26. In this case, the adsorption member 26 is required to have strong permeability, so as to avoid being blocked. The suction nozzle is made of a food-grade TPE material, or other food-grade soft rubber material.

According to the cartridge in the present disclosure, the top of the cartridge tube 10 is provided with a mating portion 15, the mating portion 15 is provided with a separate suction nozzle 20, the suction nozzle 20 is provided therein with an adsorption member 26 communicating with the flue 13, and the adsorption member 26 adsorbs most water vapor in the smoke, to avoid downward seepage of water vapor into a cigarette pole caused by water vapor condensation in the flue 13, thereby avoiding an influence on an electronic device of the cigarette pole.

Particularly referring to FIG. 2 to FIG. 9 and FIG. 17, the closure body includes a closure member 40 and a sealing member 60 integrally formed on the closure member 40. The closure member 40 includes a closure end 41, two accommodation ends 42 extending downward from two transverse sides of the closure end 41, an air passage 45 recessed downward from the middle of the closure end 41, two e-liquid passages 43 running through two sides of the closure end 41 and communicating with each other at a position below the bottom of the air passage 45, and a notch 44 provided at the accommodation end 42. The notch 44 is open in a longitudinal direction, and a stop portion 441 is formed at two longitudinal sides of the top of the notch. The air passage 45 includes a connection air passage 453 running through the closure end 41 in a vertical direction, a longitudinal air passage 451 running through the closure end 41 in a longitudinal direction, and an outer-side air passage 452 extending downward along an outer wall surface of the closure end 41 from an outer edge of the longitudinal air passage 451. A groove 421 is formed at the outer periphery of the bottom of the accommodation end 42.

The sealing member 60 is integrally formed on the closure member 40. The sealing member 60 includes a first sealing portion 61 formed at the outer periphery of the accommodation end 42, a second sealing portion 62 extending from the first sealing portion 61 to the closure end 41, and a third sealing portion 63 formed at an outer periphery of the top of the closure end 41 and integrally connected to the second sealing portion 62. The first sealing portion 61 includes a first sealing ring 612 integrally formed around outer peripheries of the accommodation end 42 and the notch 44 and an atomizing core installation cavity 611 formed at a bottom surface of the stop portion 441 of the notch 44 and at an inner side surface of the accommodation end 42. The atomizing core installation cavity 611 is recessed inward, corresponding to an outer surface of a sidewall where the outer-side air passage 452 is disposed, to form a recessed channel 614 communicating with the outer-side air passage 452. A lower end portion of the recessed channel 614 runs through a sidewall of the atomizing core installation cavity 611 to form a perforation 613. The perforation 613, the recessed channel 614, the outer-side air passage 452, the longitudinal air passage 451, and the connection air passage 453 jointly form the air passage 45.

Two sides of each of the outer-side air passage 452, the recessed channel 614, and the perforation 613 are provided with second sealing portions 62, that is, the outer-side air passage 452, the recessed channel 614, and the perforation 613 are disposed between two second sealing portions 62.

The third sealing portion 63 includes a second sealing ring 631 integrally formed around the outer periphery of the closure end 41, a third sealing ring 633 integrally formed at an inner wall surface of the connection air passage 453, and an e-liquid inlet hole 632 disposed corresponding to the e-liquid passage 43.

The atomizing core 30 is assembled to an upper end of the atomizing core installation cavity 611 of the sealing member 60. The periphery of the atomizing core 30 is surrounded by the sidewall of the atomizing core installation cavity 611. The atomizing core 30 is disposed above the perforation 613, an atomizing cavity 80 is formed below the atomizing core 30, and the perforation 613 communicates with the atomizing cavity 80. Upper edges of two longitudinal sides of the atomizing core 30 are abutted by the stop portion 441 to prevent the atomizing core 30 from moving upward. Two transverse sides of the atomizing core 30 abut against an inner wall surface of the accommodation end 42.

Figure 2:
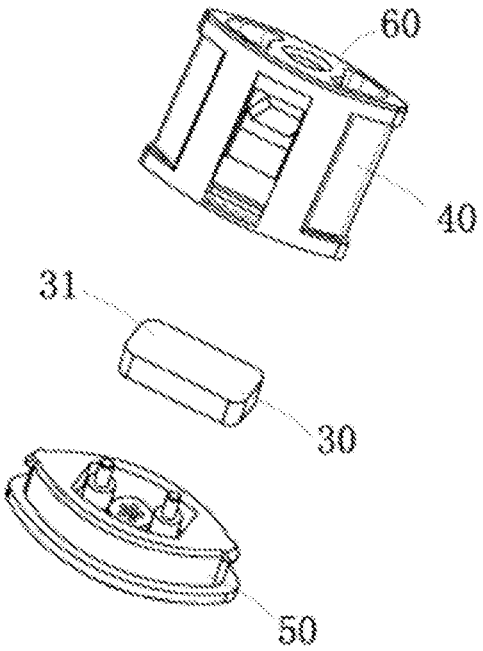
FIG. 2 is an exploded perspective view of the cartridge after removal of a cartridge tube according to the present disclosure.
Figure 3:
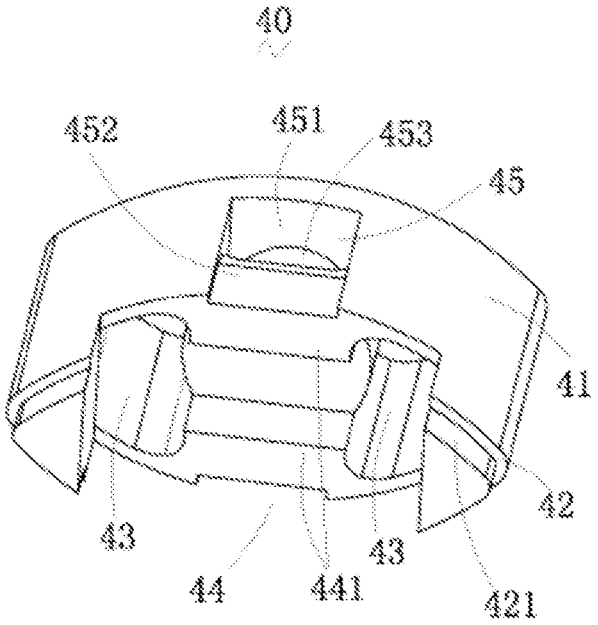
FIG. 3 is a perspective view of a closure member of the cartridge according to the present disclosure.
Figure 4:
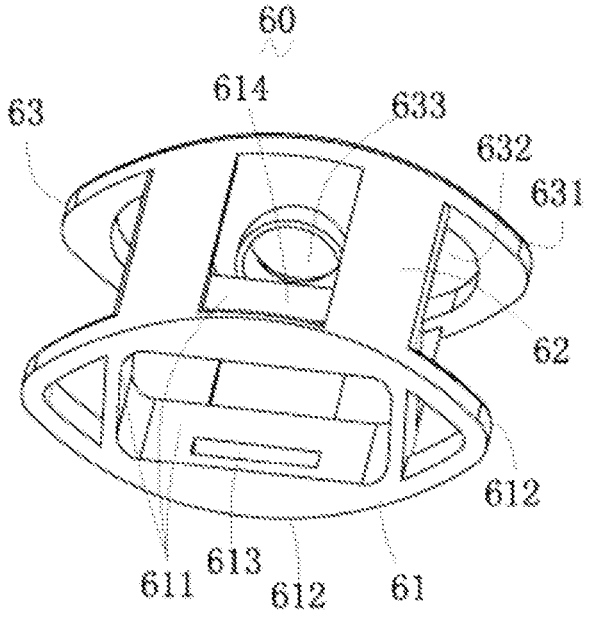
FIG. 4 is a perspective view of a sealing member of a cartridge according to the present disclosure.
Figure 5:
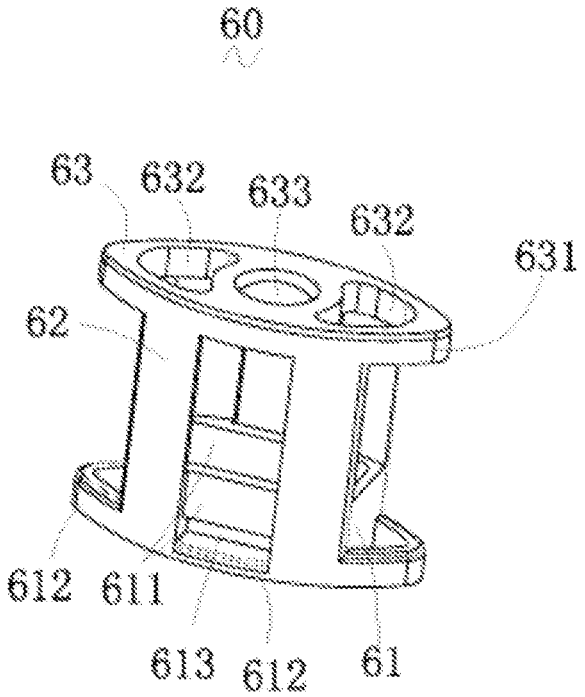
FIG. 5 is another perspective view of the sealing member of the cartridge according to the present disclosure.
Figure 6:
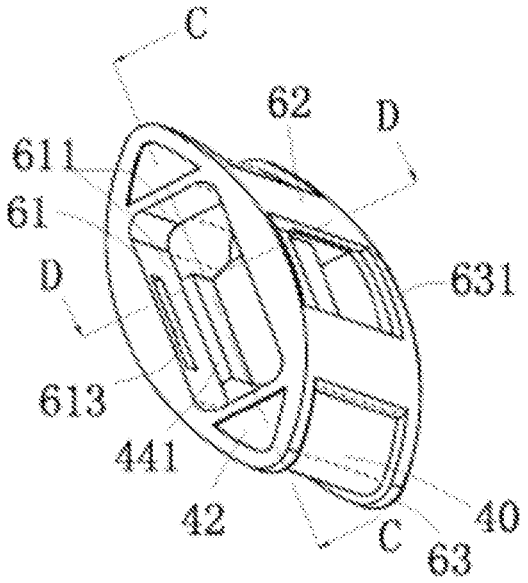
FIG. 6 is an assembled perspective view of a closure body of the cartridge according to the present disclosure.
Figure 7:
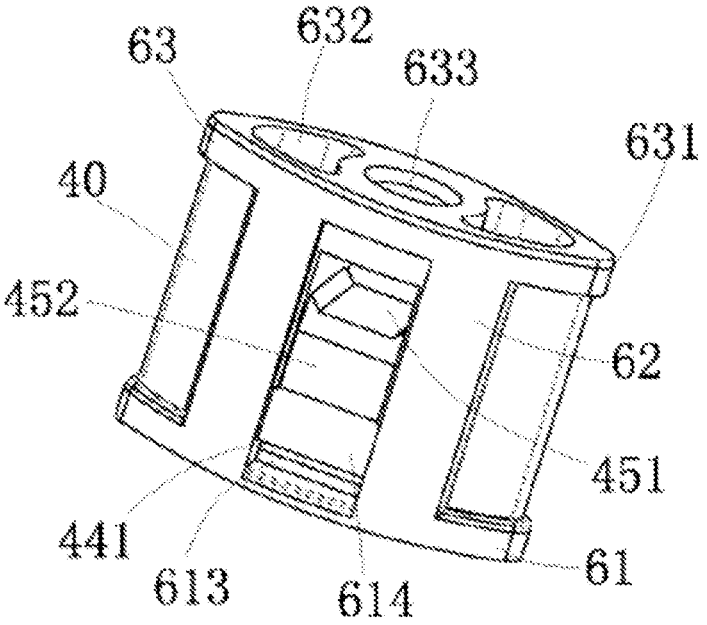
FIG. 7 is another assembled perspective view of the closure body of the cartridge according to the present disclosure.
Figure 8:
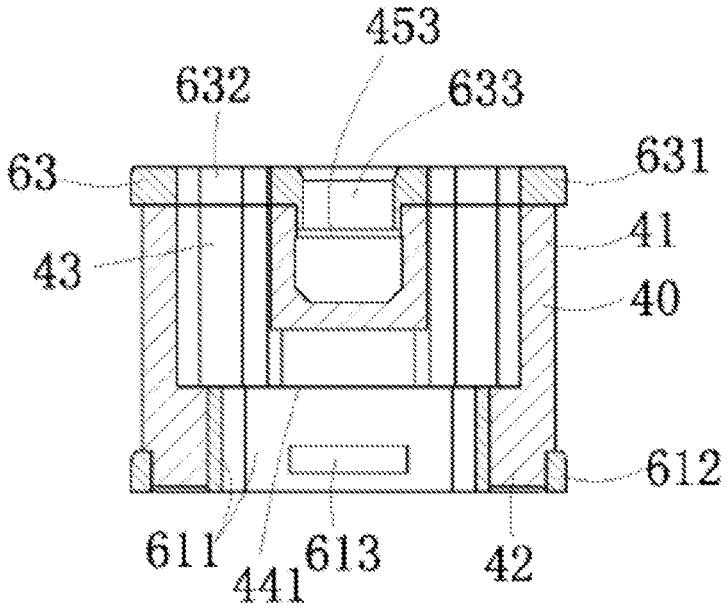
FIG. 8 is a cross-sectional view taken along a dashed line C-C in FIG. 6.
Figure 9:
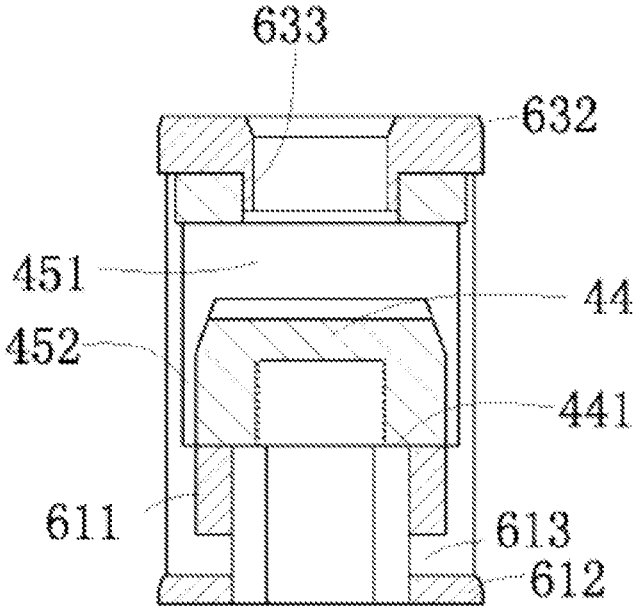
FIG. 9 is a cross-sectional view taken along a dashed line D-D in FIG. 6.
Figure 10:
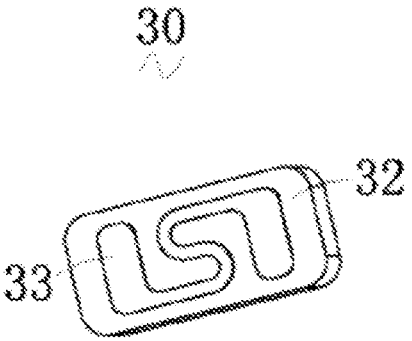
FIG. 10 is a perspective view of an atomizing core of the cartridge according to the present disclosure.

Particularly referring to FIG. 2 and FIG. 10, the atomizing core 30 includes a seepage surface 31 exposed to the e-liquid passage 43 and in contact with e-liquid in the e-liquid passage 43 and an atomizing surface 32 disposed above the atomizing cavity 80. The atomizing surface 32 is provided with a heating wire 33 for heating the atomizing core 30. The atomizing core 30 is made of a porous ceramic material.

The closure body is inserted from the bottom of the cartridge tube 10. After insertion, the insertion portion 133 at a free end of the flue 13 is inserted into the connection air passage 453 of the closure member 40 and clamps, with the inner wall surface of the connection air passage 453, the third sealing ring 633 of the sealing member 60 to achieve sealing. The first and second sealing rings 612 and 631 respectively compress an inner wall surface of the tube body 11 of the cartridge tube 10 to achieve a double-sealing structure. The second sealing portion 62 compresses the inner wall surface of the tube body 11 so that the air passage 45 is sealed independently.

The e-liquid stored in the e-liquid storage cavity 12 enters the e-liquid passage 43 of the closure member 40 through the e-liquid inlet hole 632 of the sealing member 60, so that the e-liquid is fully in contact with the seepage surface 31 of the atomizing core 30 disposed below the e-liquid passage 43. When the air passage 45 inhales in the flue 13, smoke atomized by the atomizing cavity 80 successively passes through the perforation 613, the recessed channel 614, the outer-side air passage 452, and the longitudinal air passage 451, then finally enters the flue 13 through the connection air passage 453 and is sucked out.

When the sealing member 60 is injection-molded, the first and third sealing portions 61 and 63 are integrally connected through the second sealing portion 62.

According to the closure body of the present disclosure, the sealing member 60 is integrally formed on the closure member 40, and there is no need to assemble the sealing ring separately, which can easily achieve automatic assembly. In the sealing member 60, first and second sealing rings 612 and 631 are formed respectively at the closure end 41 and the accommodation end 42 of the closure member 40. The second sealing ring 631, as the first sealing means, is in direct contact with the e-liquid storage cavity 12, and the air passage 45 disposed between the first and second sealing rings 612 and 631 is independently sealed by the second sealing portion 62, so the air passage 45 may not be polluted even if there is e-liquid seeping out of the second sealing ring 631.

Figure 11:
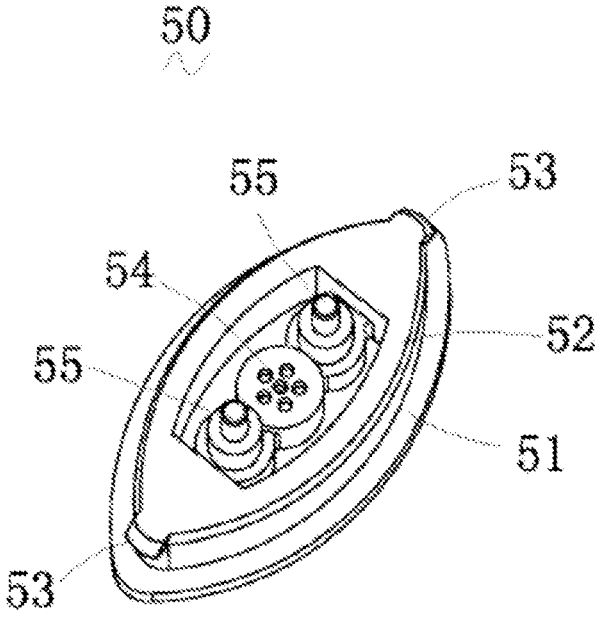
FIG. 11 is a perspective view of a base of the cartridge according to the present disclosure.
Figure 12:
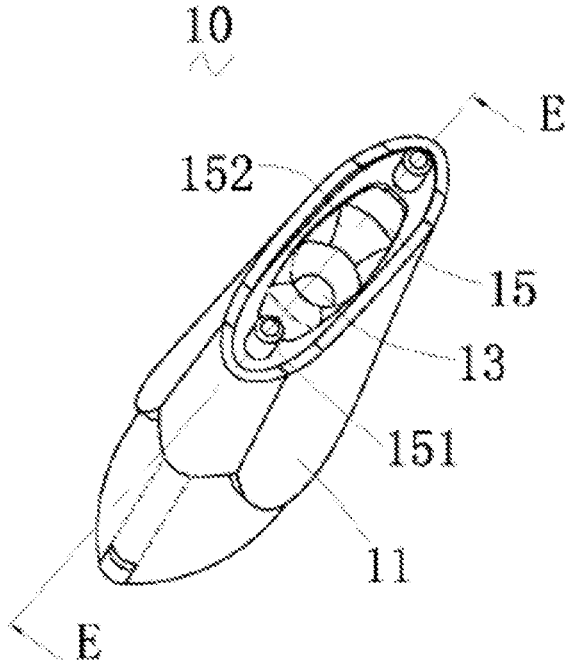
FIG. 12 is a perspective view of the cartridge tube of the cartridge according to the present disclosure.
Figure 13:
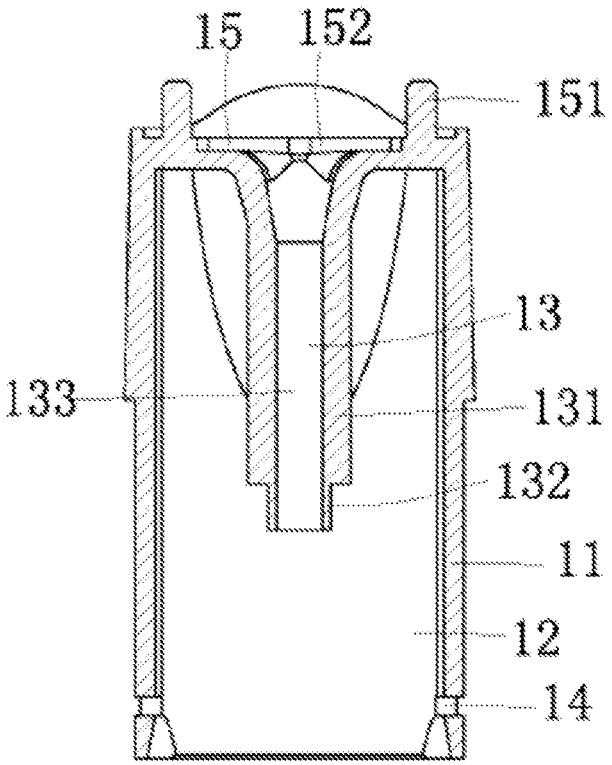
FIG. 13 is a cross-sectional view taken along a dashed line E-E in FIG. 12.
Figure 17:
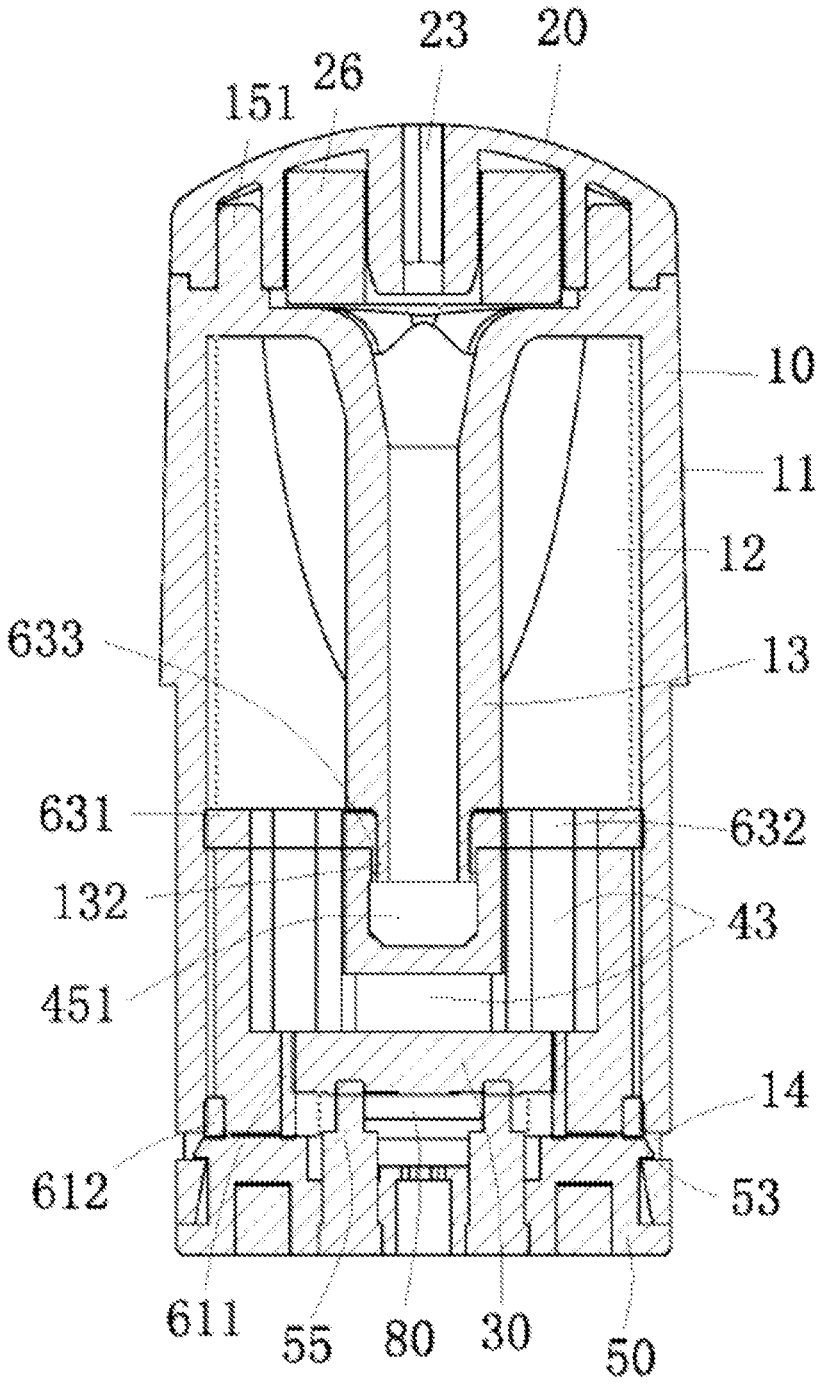
FIG. 17 is a cross-sectional view taken along a dashed line A-A in FIG. 1.
Figure 18:
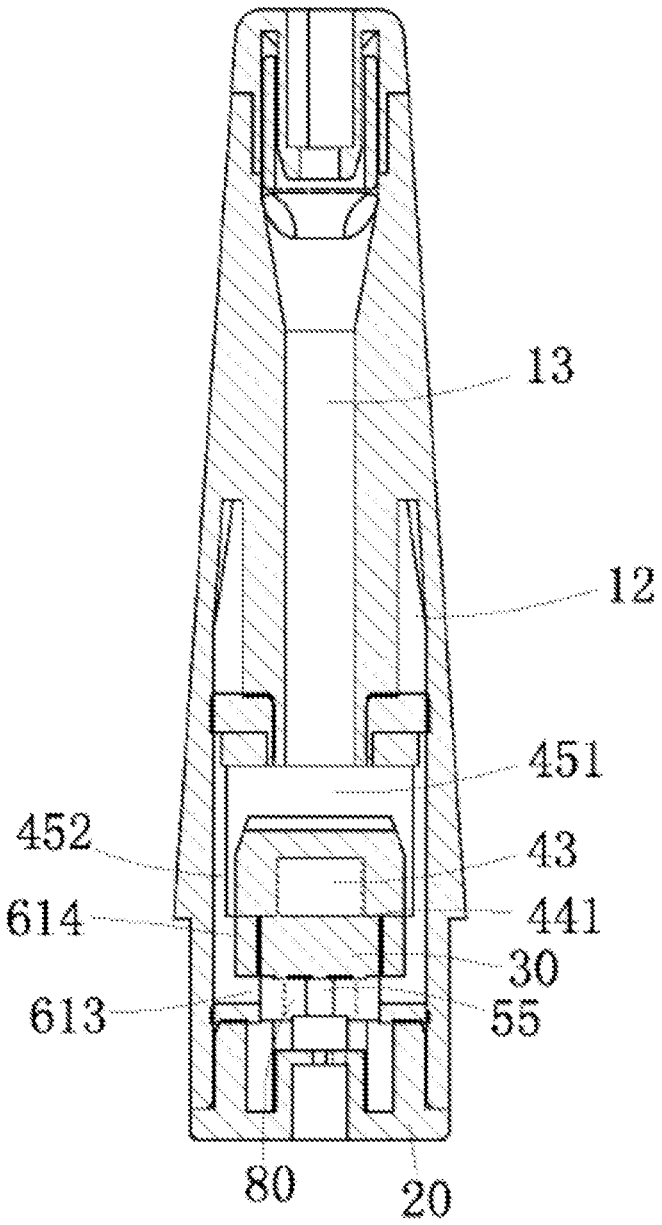
FIG. 18 is a cross-sectional view taken along a dashed line B-B in FIG. 1.

Still referring to FIG. 2, FIG. 11, and FIG. 17, the base 50 includes a base body 51 and an extension portion 52 extending upward from the base body 51 and inserted into the cartridge tube 10. Two transverse ends of the extension portion 52 are provided with second snapping portions 53 snapped with first snapping portions 14 at two transverse sides of the tube body 11 of the cartridge tube 10. The first and second snapping portions 14 and 53 are respectively in the structure of clamping holes and clamping blocks. The base 50 is integrally formed with at least one pair of conductive pillars 55 and an air inlet hole 54 running through the base 50 and communicating with the atomizing cavity 80. One pair of conductive pillars 55 respectively electrically press two ends of the heating wire 33 to transmit electric energy to heat the heating wire. The conductive pillars 55 may be elastic contact members, which abut against the heating wire 33 with elastic force and provide a certain support for the atomizing core 30 to prevent the atomizing core 30 from moving down and falling off under a strong external force.

Still referring to FIG. 1 to FIG. 18, an automatic assembly method for the cartridge in the present disclosure is as follows:

In S01, a cartridge tube 10 is provided, and the cartridge tube 10 undergoes an automatic process line, in which the cartridge tube 10 is in an inverted state.

In S02, e-liquid is injected into an e-liquid storage cavity 12 of the cartridge tube 10. At this time, the injected e-liquid cannot exceed an insertion portion 133 of a flue 13.

In S03, a closure body is provided, and the closure body is automatically pressed into the cartridge tube 10 to close an outer periphery of the e-liquid storage cavity 12 and close communication between the e-liquid storage cavity 12 and the flue 13; an atomizing core 611 is formed at one end of the closure body away from the e-liquid storage cavity 12; and the closure body is provided therein with an e-liquid passage 43 and a flue 45 independent from each other.

In this step, the closure body includes a closure member 40 and a sealing member 60 integrally formed on the closure member 40. The structures of the closure member 40 and the sealing member 60 have been described in detail previously, and are not described in details herein.

In S04, an atomizing core 30 is provided, the atomizing core 30 is automatically pressed into the atomizing core installation cavity 611, to finally close the e-liquid passage 43 in the closure body by the atomizing core 30.

In S05, a base 50 on which conductive pillars 55 are formed is provided, the base 50 is automatically pressed into the bottom of the cartridge tube 10 to hold the base 50 on the cartridge tube 10 for fixation, a top end of the base 50 abuts against the bottom of the closure body, and the conductive pillars 55 are electrically in upward contact with the atomizing core 30.

According to the closure body of the cartridge of the present disclosure, the closure member 40 and the sealing member are integrally formed, to avoid the defect that separated sealing rings need to be manually assembled and cannot be automatically assembled. Meanwhile, for the cartridge of the present disclosure, the atomizing core 30 is directly fixed into the atomizing core installation cavity 611 of the closure body, there is no need that the base 50 and the closure body clamp the atomizing core 30, the bottom of the atomizing core 30 is supported only by the conductive pillars 55, while a clamping force regarding the atomizing core 30 is from an elastic cavity wall of the atomizing core installation cavity 611. In this way, it only needs to directly automatically press the closure body, the atomizing core 30, and the base 50 successively into the cartridge tube 10, which simplifies the flow of automatic assembly. At the same time, according to the present disclosure, minimum number of parts are needed, which makes assembly thereof easier.

The above descriptions are merely embodiments of the present disclosure, and are not intended to limit the present disclosure. For those skilled in the art, the present disclosure may have various alterations and changes. Any modification, equivalent replacement, improvement, and the like made within the principle of the present disclosure shall fall within a scope claimed by claims of the present disclosure.

What is claimed is:

1. A closure body, comprising a closure member and a sealing member formed on the closure member; the closure member comprising a closure end, an accommodation end extending downward from the closure end, at least one e-liquid passage running through the closure end and extending to the accommodation end, and an air passage separated from the at least one e-liquid passage; the air passage comprising a connection air passage running through a top of the closure end, a longitudinal air passage longitudinally running through the closure end and communicating with the connection air passage, and an outer-side air passage extending from an outer edge of the longitudinal air passage to the accommodation end, wherein a notch is formed in middle of the accommodation end; the sealing member comprises a first sealing portion formed at the accommodation end, and a third sealing portion formed at the closure end; the first sealing portion comprises an atomizing core installation cavity formed in the notch, and a first sealing ring formed around outer peripheries of the accommodation end and the notch; the third sealing portion comprises a second sealing ring formed around an outer periphery of the closure end, and a third sealing ring formed at an inner side of the connection air passage; and the second sealing ring and the first sealing ring provide a double-sealing structure.

2. The closure body according to claim 1, wherein a stop portion is provided at a top of two longitudinal sides of the notch, a top of a cavity wall of the atomizing core installation cavity at one longitudinal side is formed at a lower surface of the stop portion, and cavity walls of the atomizing core installation cavity at two transverse sides are integrally formed at an inner side surface of the accommodation end.

3. The closure body according to claim 2, wherein a cavity wall of the atomizing core installation cavity at a longitudinal side is recessed inward, corresponding to a lower part of the outer-side air passage, to form a recessed channel, and a perforation is formed by running through the recessed channel; an atomizing cavity communicating with the perforation is formed at a lower part of the atomizing core installation cavity; the perforation, the recessed channel, the outer-side air passage, the longitudinal air passage, and the connection air passage form the air passage.

4. The closure body according to claim 3, wherein the sealing member further comprises a second sealing portion integrally formed with the first sealing portion and the third sealing portion and extending along an outer side surface of the closure member, the at least one e-liquid passage is two e-liquid passages, which are formed by running through two sides of the closure end and communicate with each other at a position below a bottom of the air passage, and the two e-liquid passages are disposed above the atomizing core installation cavity.

5. The closure body according to claim 4, wherein the second sealing portion is formed at two sides of the perforation, the recessed channel, the outer-side air passage, and the longitudinal air passage, and the second sealing portion independently seals the perforation, the recessed channel, the outer-side air passage, and the longitudinal air passage, so as to avoid pollution of the air passage when oil leakage occurs in the third sealing ring.

6. A cartridge, comprising a cartridge tube provided with a flue and an e-liquid storage cavity, a closure body installed in the cartridge tube and closing the e-liquid storage cavity, an atomizing core installed in the closure body, and a base fixed to the cartridge tube, wherein the closure body comprises a closure member and a sealing member formed on the closure member; the closure member comprises a closure end, an accommodation end extending downward from the closure end, at least one e-liquid passage running through the closure end and extending to the accommodation end, an air passage separated from the at least one e-liquid passage, and a notch provided in middle of the accommodation end; the sealing member comprises an atomizing core installation cavity formed in the notch; the atomizing core is placed and fixed in the atomizing core installation cavity; the base is provided with a conductive pillar connected to a power supply, and the conductive pillar abuts against a lower surface of the atomizing core to provide support for the atomizing core; an upper part of the base abuts against a lower part of the accommodation end; and the base is fixed to the cartridge tube;

wherein the air passage comprises a connection air passage running through a top of the closure end, a longitudinal air passage longitudinally running through the closure end and communicating with the connection air passage, and an outer-side air passage extending from an outer edge of the longitudinal air passage to the accommodation end; the sealing member further comprises a third sealing portion formed at the closure end, and the third sealing portion comprises a second sealing ring formed around an outer periphery of the closure end and a third sealing ring formed at an inner side of the connection air passage; the second sealing ring is clamped between an inner wall surface of a tube body and an outer side surface of the closure end, and the third sealing ring is clamped between an inner wall surface of the connection air passage and an outer side surface of a free end of the cartridge;

wherein a stop portion is provided at a top of two longitudinal sides of the notch, a top of a cavity wall of the atomizing core installation cavity at one longitudinal side is formed at a lower surface of the stop portion, and cavity walls of the atomizing core installation cavity at two transverse sides are integrally formed at an inner side surface of the accommodation end;

wherein a cavity wall of the atomizing core installation cavity at a longitudinal side is recessed inward, corresponding to a lower part of the outer-side air passage, to form a recessed channel, and a perforation is formed by running through the recessed channel; an atomizing cavity communicating with the perforation is formed at a lower part of the atomizing core installation cavity; the perforation, the recessed channel, the outer-side air passage, the longitudinal air passage, and the connection air passage form the air passage; and wherein the sealing member further comprises a first sealing ring formed at the accommodation end, and a second sealing portion integrally formed with the first sealing ring and the second sealing ring and extending along an outer side surface of the closure member.

7. The cartridge according to claim 6, wherein the base is not in direct contact with the atomizing core.

8. The cartridge according to claim 7, wherein the cartridge tube comprises a tube body, two transverse sides of a bottom of the tube body are provided with a first snapping portion, and two transverse sides of the base are provided with a second snapping portion snapped with the first snapping portion.

9. The cartridge according to claim 6, wherein the second sealing portion is formed at two sides of the perforation, the recessed channel, the outer-side air passage, and the longitudinal air passage, and the second sealing portion independently seals the perforation, the recessed channel, the outer-side air passage, and the longitudinal air passage, so as to avoid pollution of the air passage when oil leakage occurs in the third sealing ring.

10. The cartridge according to claim 6, wherein the at least one e-liquid passage is two e-liquid passages, which are formed by running through two sides of the closure end and communicate with each other at a position below a bottom of the air passage, the two e-liquid passages are disposed above the atomizing core installation cavity, an atomizing cavity is disposed below the atomizing core, and the perforation communicates with the atomizing cavity.

11. The cartridge according to claim 6, wherein the atomizing core comprises a porous ceramic matrix, a seepage surface of the ceramic matrix facing the at least one e-liquid passage, and an atomizing surface of the ceramic matrix facing the atomizing cavity, the atomizing core is provided with a heating wire, two ends of the heating wire are connected through two conductive regions on the atomizing surface, and the conductive pillar on the base is held on the conductive regions and provides a support force for the atomizing core.

12. The cartridge according to claim 6, wherein assembling of the cartridge comprises the following steps:

S01, making the cartridge tube undergo an automatic process line, in which the cartridge tube is in an inverted state;

S02, injecting e-liquid into the e-liquid storage cavity of the cartridge tube;

S03, automatically pressing the closure body into the cartridge tube to close an outer periphery of the e-liquid storage cavity and close communication between the e-liquid storage cavity and the flue;

S04, automatically pressing the atomizing core into the atomizing core installation cavity, to finally close the at least one e-liquid passage in the closure body by the atomizing core; and S05, automatically pressing the base into a bottom of the cartridge tube to hold the base on the cartridge tube for fixation, a top end of the base abutting against a bottom of the closure body, the conductive pillar being electrically contact with the atomizing core, and the conductive pillar providing support for the atomizing core.

13. A cartridge, comprising a cartridge tube provided with a flue and an e-liquid storage cavity, a closure body installed in the cartridge tube and closing the e-liquid storage cavity, an atomizing core installed in the closure body, and a base fixed to the cartridge tube, wherein the cartridge further comprises a suction nozzle disposed at a top end of the cartridge tube; the suction nozzle comprises a top portion, an insertion portion extending downward from the top portion, and a suction hole running through the top portion and the insertion portion; the insertion portion is provided with an adsorption space at an outer periphery of the suction hole; an adsorption member is provided in the adsorption space; and the adsorption space communicates with the flue to make the adsorption member adsorb water vapor of smoke in the flue, wherein the closure body comprises a closure member and a sealing member formed on the closure member; the closure member comprising a closure end, an accommodation end extending downward from the closure end, at least one e-liquid passage running through the closure end and extending to the accommodation end, and an air passage separated from the at least one e-liquid passage; and wherein a notch is formed in middle of the accommodation end; the sealing member comprises a first sealing portion formed at the accommodation end, and a third sealing portion formed at the closure end; the first sealing portion comprises an atomizing core installation cavity formed in the notch, and a first sealing ring formed around outer peripheries of the accommodation end and the notch; the third sealing portion comprises a second sealing ring formed around an outer periphery of the closure end, and a third sealing ring formed at an inner side of the air passage; and the second sealing ring and the first sealing ring provide a double-sealing structure.

14. The cartridge according to claim 13, wherein the cartridge tube comprises a tube body, the e-liquid storage cavity and the flue are formed in the tube body, the flue runs through in a vertical direction, and a top of the tube body is provided with a mating portion for the suction nozzle;

wherein two sides of the insertion portion are provided with positioning holes, and two sides of the mating portion are provided with positioning pillars mating with the positioning holes; and wherein a suction cavity with a trumpet-shaped opening is formed at a top of the flue, the adsorption member communicates with the suction cavity, and the insertion portion of the suction nozzle is inserted into the suction cavity.

15. The cartridge according to claim 14, wherein the adsorption member completely covers an upper part of the flue, and the suction hole communicates with the flue through the adsorption member; wherein the suction hole forms a cylindrical structure in the adsorption space, the adsorption member is fitted in the adsorption space outside the cylinder structure, and the suction hole directly communicates with the flue.

* * * * *